United States Patent [19]

Sato

[11] 4,304,507

[45] Dec. 8, 1981

[54] METHOD FOR PRODUCING A CONTINUOUS WALL

[76] Inventor: Hiroichi Sato, 109, Wadasakunouchi, Sukagawa-shi, Fukushima, Japan

[21] Appl. No.: 85,040

[22] Filed: Oct. 15, 1979

[51] Int. Cl.[3] ..... E02D 5/18

[52] U.S. Cl. ..... 405/267; 405/240; 405/248

[58] Field of Search ..... 405/240, 248, 267, 269

[56] References Cited

U.S. PATENT DOCUMENTS

| | | | |
|---|---|---|---|
| 3,645,101 | 2/1972 | Sherard | 405/267 |
| 3,851,490 | 12/1974 | Matsushita | 405/248 |
| 4,005,582 | 2/1977 | Tamaro | 405/267 |
| 4,057,969 | 11/1977 | Rochmann | 405/267 |
| 4,249,836 | 2/1981 | Schmednecht | 405/267 |

*Primary Examiner*—David H. Corbin

*Attorney, Agent, or Firm*—Leydig, Voit, Osann, Mayer & Holt, Ltd.

[57] ABSTRACT

A method for producing a continuous wall is disclosed which comprises the steps of digging at least two holes in the ground, inserting into each of the holes a supporting means, supporting a continuous wall producing apparatus by the supporting means such that the continuous wall producing apparatus can be moved up and down along the supporting means serving as a guide, supplying highly pressurized water, the supporting means and pressurized air to the continuous wall producing apparatus, lowering the continuous wall producing apparatus, while forming a pressurized air zone in the ground and jetting highly pressurized water to dig the ground in a plate like form, and elevating the continuous wall producing apparatus while pouring a grout material into the dug out space thus formed.

An apparatus for producing a continuous wall in the ground which comprises a pair of special reducers, a connecting member or members, a first discharge orifice provided with the special reducer for effecting downward discharging, a second discharge orifice provided with said special reducer for effecting discharging along the length of the connecting member, and an air blow pipe provided with a multiplicity of small orifices, arranged above the connecting member or members is provided.

3 Claims, 12 Drawing Figures

METHOD FOR PRODUCING A CONTINUOUS WALL

BACKGROUND OF THE INVENTION

1. Field of the Invention

The present invention relates to a process for producing a continuous wall in the ground and an apparatus for use in working such method. More particularly, the present invention relates to a method, and apparatus, for producing a continuous wall in the ground in which the earth is dug or excavated by means of highly pressurized water and after the digging is completely filling in the hollow or cavity so formed with a grout material.

2. Description of the Prior Art

Various methods for producing walls for the purpose of cutting off water, retaining of earth and the like by injecting grout materials into the ground have heretofore been proposed. For example, it has been conventionally known to dig the ground using a boring rod provided with a tip pit which is rotated to form a cylindrical hollow, pour a grout material into the hollow, said grout material being set or solidified to form a cylindrical solid body, and repeat this procedure such that the solid bodies are adjacent to each other.

The above-described conventional method, however, is disadvantageous in that it takes a considerably long period of time for a continuous wall to be made and also it is troublesome. Further, it has a disadvantage that it is quite difficult to obtain a continuous wall having a uniform thickness over the whole extension thereof, which would very often lead to unsatisfactory strength.

SUMMARY OF THE INVENTION

It is an object of the present invention to provide a method for producing a continuous wall of a uniform thickness in the ground which can be employed with ease and is free from the above-described drawbacks of the conventional methods.

Also, it is an object of the present invention to provide an apparatus for producing a continuous wall in the ground which is suitable for working the method of the present invention efficiently.

According to the present invention there is provided a method for producing a continuous wall which comprises the steps of digging at least two holes in the ground, inserting into each of the holes a supporting means, supporting a continuous wall producing apparatus by the supporting means such that the continuous wall producing apparatus can be moved up and down along the supporting means, the supporting means serving as a guide, supplying highly pressurized water and pressurized air to the continuous wall producing apparatus, lowering the continuous wall producing apparatus, while forming a pressurized air zone in the ground and jetting highly pressurized water to dig the ground in a plate like form, and elevating the continuous wall producing apparatus while pouring a grout material into the dug space thus formed.

Also according to the present invention there is provided an apparatus producing a continuous wall in the ground which comprises a pair of special reducers, a connecting member or members, a first discharge orifice provided with the special reducer for effecting downward discharging, a second discharge orifice provided with said special reducer for effecting discharging along the length of the connecting member, and an air blow pipe provided with a multiplicity of small orifices, arranged above the connecting member or members.

BRIEF DESCRIPTION OF THE DRAWINGS

The above and other purposes of the invention will become apparent from the following description with reference to the accompanying drawings, in which one embodiment is shown by way of example. It is to be understood that this embodiment is only illustrative of the present invention and that various modifications thereof may be made within the scope of the claims following hereafter.

In FIGS. 1 and 2, a continuous wall producing apparatus 1 comprises two special reducers 2 connected to an inner connecting plate 3 and to an outer connecting plate 4, and an air blow pipe 5 provided above the outer connecting plate 4. The special reducer 2 comprises, as shown in FIGS. 3, 4 and 5, a drum 6 welded to the inner connecting plate 3 and the outer connecting plate 4, an internal thread member 7 which is screwed on the inner surface of the upper opening of the drum 6, a tip drum 8 screwed on the lower opening of the drum 6 and cover 9 screwed on the tip of the tip drum 8.

Figure 1:
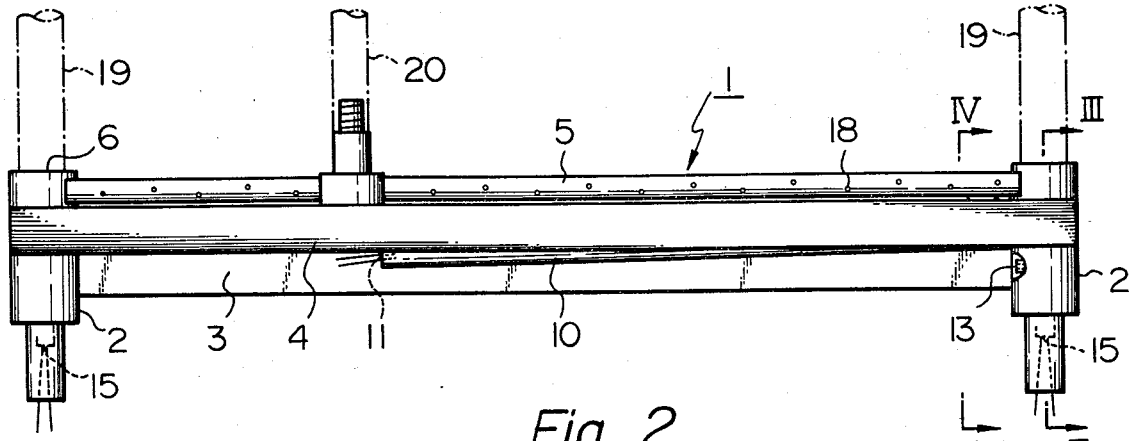
FIG. 1 is a front view of a continuous wall producing apparatus according to one embodiment of the present invention.
Figure 2:
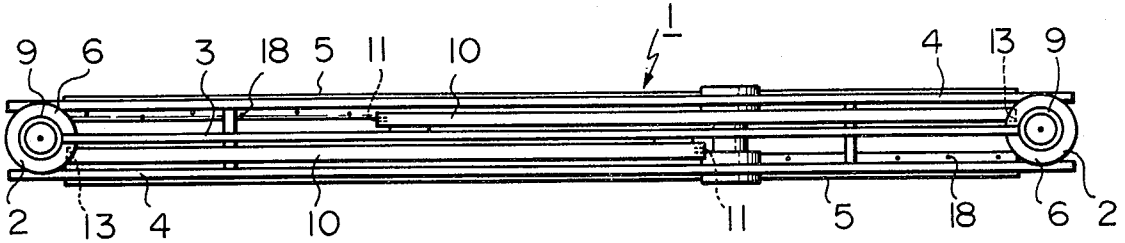
FIG. 2 is a bottom view of the apparatus according to the present invention.
Figure 3:
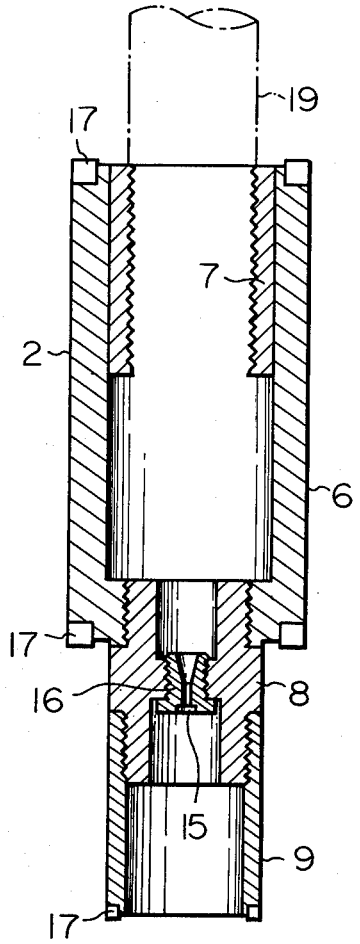
FIG. 3 is a sectional view of the apparatus according to the present invention along the line III—III of FIG. 1.
Figure 4:
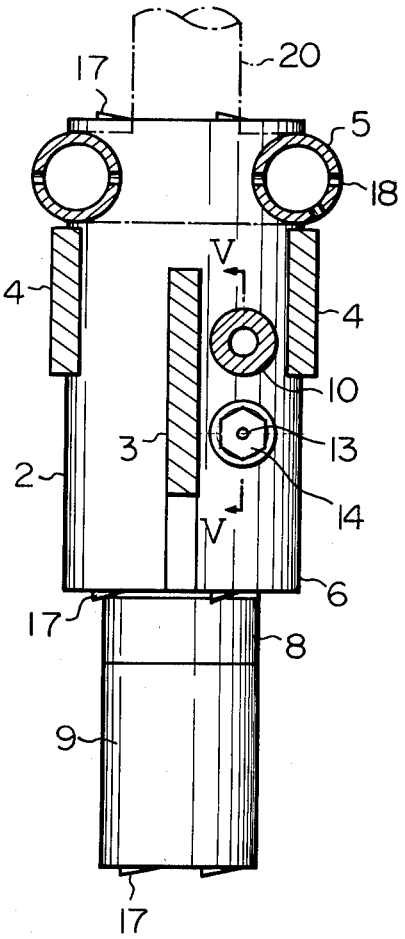
FIG. 4 is a sectional view of the apparatus according to the present invention along the line IV—IV of FIG. 1.
Figure 5:
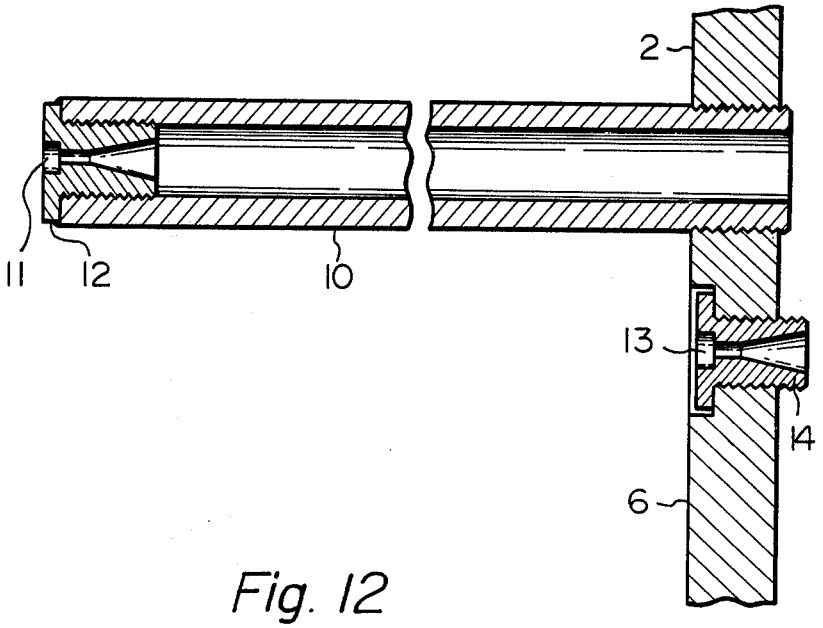
FIG. 5 is a sectional view of the apparatus according to the present invention along the line V—V of FIG. 4.

The distance between the two reducers 2 can be adjusted such that it is slightly smaller than the distance between two supports such as H shaped steel members, which serve as a guide for the continuous wall producing apparatus 1.

At the side surface or periphery of the drum 6 an extender pipe 10 is fixed with a screw in such a manner as to be arranged parallel to the longitudinal direction of the inner connecting plate 3. A nozzle member 12 is attached with a screw at the top of the extender pipe 10. The nozzle member 12 is provided with a discharge orifice 11. Also, at the side surface or periphery of the drum 6 there is fixed with a screw a nozzle member 14 which is provided with a discharge orifice 13 below the extender pipe 10. Within the cavity of the tip drum 8 there is fixed coaxially therewith with a screw a nozzle member 16 provided with a discharge orifice 15. The afore-said cover 9 is to prevent the discharge orifice 15 from being clogged with earth and sand and is provided with a digging tip 17 at the extremity thereof. Also, a digging tip 17 is provided at each of the upper and lower ends of the drum 6. On the other hand, the air blow pipe 5 is provided with a multiplicity of small orifices 18 through which air is blown out. Further, pressurized injection pipes 19 which are screwed with the internal thread member 7 are provided on the inner cavity of the drum 6 of the special reducer 2 and an air supply pipe 20 is attached to the air blow pipe 5.

Figure 6:
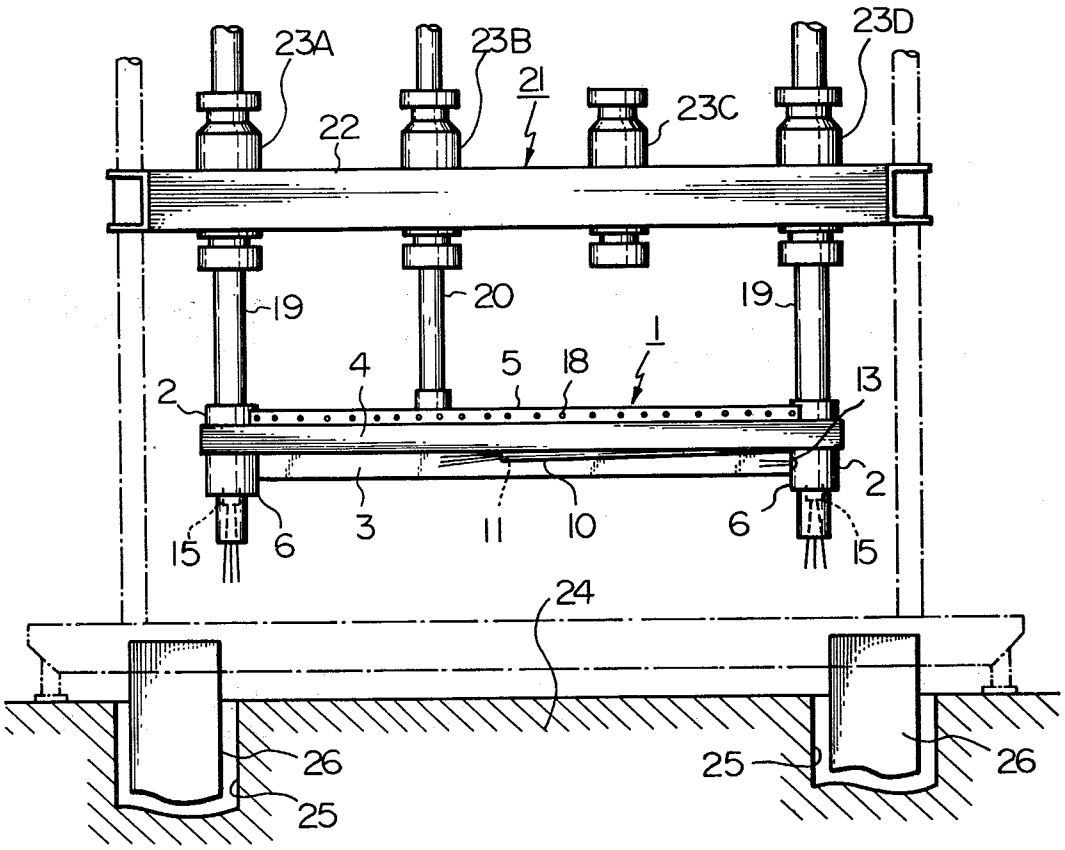
FIG. 6 is a front view of the apparatus for producing a continuous wall arranged on a multi-axial boring machine.

The above-described continuous wall producing apparatus 1 is usually used, as shown in FIG. 6, in a state where it is installed in a multi-axial boring machine 21. The multi-axial boring machine 21 comprises a frame 22 which has a plurality of chucks 23A, 23B, 23C and 23D connected thereto and which is driven by a hydraulic cylinder (not shown) up and down. The pressurized injection pipes 19 are supported by the chucks 23A and 23D respectively, and the air supply pipe 20 is supported by the chuck 23B.

Now, referring to the accompanying drawings the operation of the continuous wall producing apparatus 1 and the method of producing a continuous wall will be explained in greater detail as follows.

Figure 7:
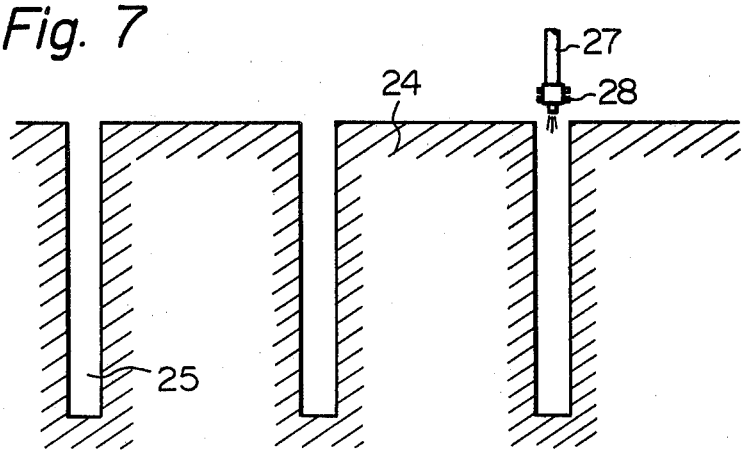
FIG. 7 is a schematical sectional view which illustrates a procedure for forming a cavity for inserting therein a support member according to an embodiment of the method for producing a continuous wall in the ground in accordance with the present invention.

First of all, as shown in FIG. 7, on the ground 24 are formed a plurality of hollows or holes 25 for inserting therein support members at a predetermined distance one from another. This procedure can be effected by means of a boring machine (not shown) provided with a boring rod 27 to which a tip reducer 28 attached lowers the boring rod 27 with rotation.

Figure 8:
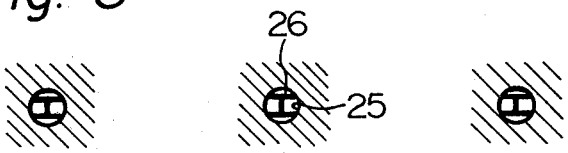
FIG. 8 is a plane view which illustrates a condition where an H shaped steel member is inserted into a cavity for receiving a support member.
Figure 9:
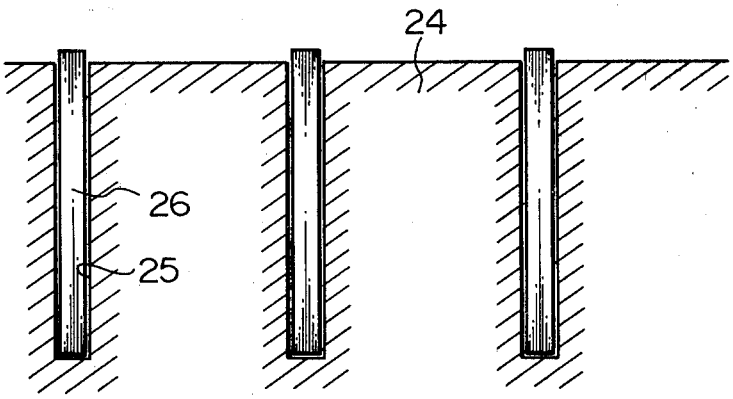
FIG. 9 is a sectional view which shows the same condition as FIG. 8.

Subsequently, H shaped steel member as a support members are inserted into the holes 25, and fixed therein as shown in FIGS. 8 and 9, followed by setting the multi-axial boring machine 21 between two H shaped steel members 26 between which a continuous wall is to be formed. The multi-axial boring machine 21 supports the continuous wall producing apparatus 1 such that it can be moved up and down with the aid of the two adjacent H shaped steel members 26 as a guide.

Figure 10:
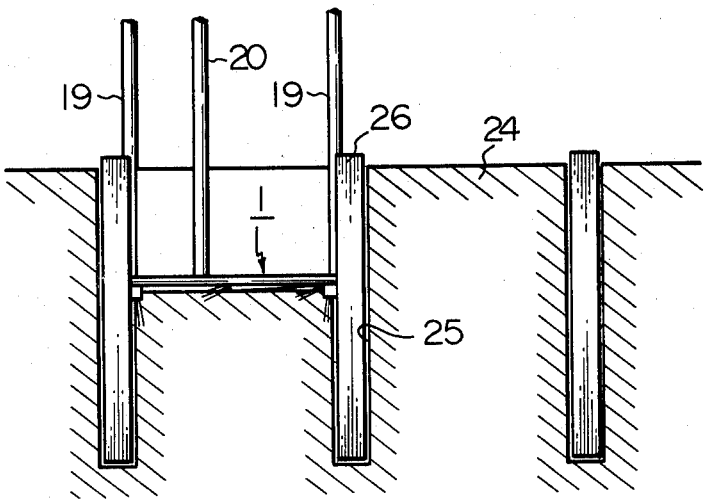
FIG. 10 is a sectional view which illustrates a procedure of digging the ground by means of the continuous wall producing apparatus according to the present invention.

Next, the continuous wall producing apparatus 1 is lowered gradually by the multi-axial boring machine 21 along the guide, i.e. H shaped steel, while supplying highly pressurized water through the pressurized injection pipes 19 and pressurized air through the air supply pipe 20 onto the surface of the ground to be excavated. In this case, it is preferred to effect digging by lowering the continuous wall producing apparatus 1 with a small amplitude reciprocal motion but not by monotonous lowering in order to achieve more efficient digging. By so doing, the continuous wall producing apparatus 1 jets highly pressurized water through the discharge orifices 11, 13 and 15 in the direction parallel to the longitudinal axis of the inner connecting plate 3 and in the downward direction to dig the ground 24 as shown in FIG. 10. During this procedure, air which is discharged from a multiplicity of the small orifices 18 of the air blow pipe 5 forms a pressurized air zone on the upper of the continuous wall forming apparatus 1 which prevents the muddy water or slurry from remaining around the apparatus 1 with reducing the impetus of the discharged highly pressurized water, so that an efficient digging of the ground can be assured. The muddy water containing earth and sand, or slurry is lifted by the pressurized air and conveyed by a pump (not shown) up onto the open surface of the ground and excluded.

The provision of the extender pipe 10 provided with the discharge orifice 11 which permits of jetting highly pressurized water at the middle position makes it possible to form a dug out space of satisfactory width or span at a time.

Figure 11:
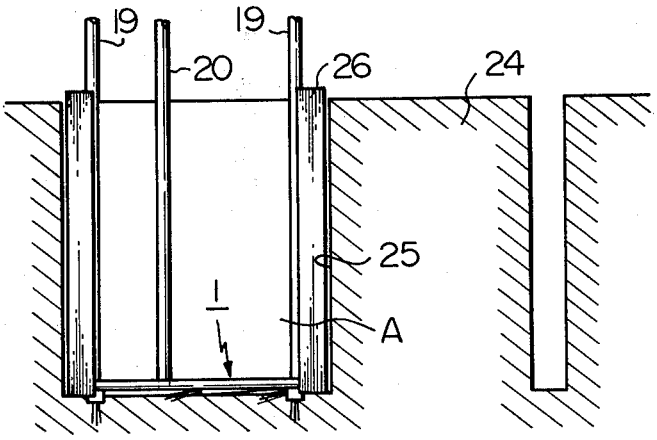
FIG. 11 is a sectional view which illustrates a condition where digging is complete.

As illustrated in FIG. 11, when the excavation of the ground 24 to a desired depth is completed and a plate like dug out space A is formed between the two H shaped steel members 26, a grout material such as cement milk is supplied through the pressurized injection pipes 19 and air of a lower pressure than in the previous step is supplied through the air supply pipe 20 while elevating gradually the continuous wall producing apparatus 1. As a result the grout material is discharged from the discharge orifices 11, 13 and 15 under high pressure and the dug out space is filled therewith. During the procedure, the pressurized air discharged from the air blow pipe 5 will reduce considerably the friction between the continuous wall producing apparatus 1 and the ground 24, thus facilitating the elevation or withdrawal of the apparatus 1. It is preferred upon removal of the apparatus from the dug out space to impart to the apparatus a reciprocal motion of small amplitude to minimize resistance to removal.

Figure 12:
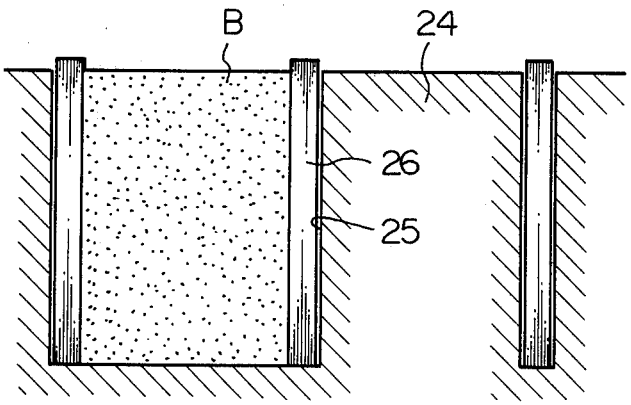
FIG. 12 is a sectional view which illustrates a condition where a continuous wall in the ground is complete according to the present invention.

After the continuous wall forming apparatus 1 has been withdrawn and the dug out space has been filled with grout material, a continuous wall unit B of solidified grout material is formed along the span of the ground 24 defined between the H shaped steel member support guides as shown in FIG. 12.

By moving the multi-axial boring machine and the continuous wall producing apparatus 1 to the adjacent span or region and repeating the same steps as explained above, a continuous wall of any desired length can be produced in the ground.

As stated in the foregoing, according to the present invention the ground can be dug out in a plate like form by the action of highly pressurized water jetted horizontally along the length of the "plate" as well as downward in combination with the action of pressurized air, and a continuous wall of a uniform thickness can be readily obtained by pouring a grout material into the dug out space thus formed and solidifying it therein. Further, a satisfactory width of digged space can be produced at a time because of the provision of an extender pipe which allows jetting of highly pressurized water at the middle portion of the inner connecting plate, resulting in improved efficiency.

What is claimed is:

1. A procedure for forming a hardened underground vertical wall which comprises progressively lowering into the ground a framework having a first set of spaced orifices directed generally horizontally and a second set of spaced orifices directed vertically downward, said first and second set of orifices arranged substantially in a common plane, applying to the orifices a source of highly pressurized water to create earth-eroding jets to form a progressively deeper groove in the earth as the framework is lowered, releasing high pressure air in the region above the jets so that the resulting mixture of water and earth is forced by the action of bubbles upwardly and out of the groove, disconnecting the sources of water and air after the groove has reached the desired depth, forcing liquid grout through the orifices as the framework is progressively raised until the groove is substantially filled and the framework is completely withdrawn, and allowing the grout to harden in place.

2. A procedure for forming a hardened underground vertical wall which comprises progressively lowering into the ground a framework having a first set of spaced orifices directed generally horizontally and a second set of spaced orifices directed vertically downward, said first and second set of orifices arranged substantially in a common plane, applying to the orifices a source of highly pressurized water to create earth-eroding jets to form a progressively deeper groove in the earth as the framework is lowered, releasing high pressure air in the region above the jets so that the resulting mixture of water and earth is forced by the action of bubbles upwardly and out of the groove, and after the groove has reached the desired depth, progressively raising the framework while pouring a grout material into the groove until the groove is substantially filled and the framework is completely withdrawn, and allowing the grout to harden in place.

3. The procedure of claims 1 or 2 wherein the framework is lowered and raised on support means placed in the ground, said support means serving as a guide for the framework.

* * * * *

UNITED STATES PATENT AND TRADEMARK OFFICE

CERTIFICATE OF CORRECTION

PATENT NO. : 4,304,507

DATED : December 8, 1981

INVENTOR(S) : Hiroichi Sato

It is certified that error appears in the above-identified patent and that said Letters Patent are hereby corrected as shown below:

ABSTRACT

Column 2, line 6, delete ", the supporting"

Column 2, line 7, delete "means"

Column 2, line 5, after "means" insert -- , the supporting means--.

Signed and Sealed this

Nineteenth Day of October 1982

[SEAL]

*Attest:*

GERALD J. MOSSINGHOFF

*Attesting Officer*

*Commissioner of Patents and Trademarks*